US006290148B1

(12) United States Patent
Rizk et al.

(10) Patent No.: US 6,290,148 B1
(45) Date of Patent: Sep. 18, 2001

(54) DEVICE FOR DELAYING THE DEFLECTION OF THE NOZZLE NEEDLE OF A FUEL INJECTION VALVE

(75) Inventors: Reda Rizk, Köln; Wilhelm Frank, Bamberg, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/395,227

(22) Filed: Sep. 13, 1999

(30) Foreign Application Priority Data

Sep. 16, 1998 (DE) ..... 198 42 428
Aug. 26, 1999 (DE) ..... 199 40 558

(51) Int. Cl.[7] ..... F02M 61/20
(52) U.S. Cl. ..... 239/533.9
(58) Field of Search ..... 239/533.3, 533.6, 239/533.9

(56) References Cited

U.S. PATENT DOCUMENTS 4,531,676 * 7/1985 Seifert et al. ..... 239/533.3 X
4,684,067 * 8/1987 Cotter et al. ..... 239/533.3
4,911,366 * 3/1990 Priesner ..... 239/533.3
5,205,492 * 4/1993 Khinchuk ..... 239/533.9 X
5,267,694 * 12/1993 Frank et al. ..... 239/533.3 X
5,727,738 * 3/1998 Hofmann et al. ..... 239/533.4

FOREIGN PATENT DOCUMENTS

3839812 * 4/1968 (DE) ..... 239/533.9
3041018 * 5/1982 (DE) .
3344723 * 6/1984 (DE) .
88 09 257 12/1989 (DE) .
3900763 * 7/1990 (DE) .
4126698 * 10/1992 (DE) .
4340305 * 6/1995 (DE) .
1110102 * 4/1968 (GB) .
2086473 * 5/1982 (GB) .
10-122078 * 5/1998 (JP) .

* cited by examiner

*Primary Examiner*—Lesley D. Morris
(74) *Attorney, Agent, or Firm*—Herbert L. Lerner; Laurence A. Greenberg; Werner H. Stemer

(57) ABSTRACT

A nozzle needle (60) of a fuel injection valve is guided axially in a nozzle body (50), and it points with its rear end face (61) into a compression chamber (15) and is operatively connected to a damping body (40). The recesses (46, 47, 48) of the damping body (40), together with the damping bore (14), form a fuel-filled damping chamber (40). Upon valve opening, the fuel in the compression chamber is compressed, and thus the valve opening is delayed. If the nozzle needle exceeds the damping stroke (hd), then the fuel is depressurized by a communication with an outflow chamber (12). The damping body is guided over at least part of its length in the damping bore.

10 Claims, 7 Drawing Sheets

DEVICE FOR DELAYING THE DEFLECTION OF THE NOZZLE NEEDLE OF A FUEL INJECTION VALVE

BACKGROUND OF THE INVENTION

Field of the Invention

The invention relates to a fuel injection valve and a method for setting a predeterminable damping stroke of a fuel injection valve.

In a common rail injection system, before the main injection a preinjection (pilot injection) is made, in order to achieve gentler combustion in the combustion chamber of the internal combustion engine and thus reduce the noise output by the engine. The fuel quantity dispensed into the combustion chamber in the pilot injection is smaller than the fuel quantity in the main injection. In known fuel injection valves, the opening of the injection valve is delayed in order to attain small injection quantities.

From German Patent Disclosure DE 43 40 305 A1, a fuel injection valve is known in which during the valve opening, a defined volume is positively displaced into an annular chamber, and this volume is diverted via a throttle and the valve opening is thus delayed in a defined manner.

From Japanese Patent Disclosure 10122078 A, an injector is known in which a nozzle needle is axially displaceably disposed in the guide bore of a nozzle body and opens with a delay, after the valve opening, up to a predetermined damping stroke. On its upper end, the nozzle needle has a cylindrical shaft, which in turn is subdivided by a shoulder into an upper shaft part of larger diameter and a lower shaft part of smaller diameter. The shaft is disposed axially displaceably in the damping bore of a damping unit. If the deflection of the nozzle needle exceeds the damping stroke, then fuel flows out through the annular gap that is formed by the lower shaft part and the damping bore. The nozzle needle and the shaft are embodied in one piece, comprising a single body.

SUMMARY OF THE INVENTION

The object of the invention to furnish a fuel injection valve in which the valve opening of a fuel injection valve is delayed by means that are simple to produce.

In the invention, upon valve opening, the fuel is compressed in a damping chamber and a compression chamber communicating with the damping chamber, so that a damping force that delays the valve opening acts on the nozzle needle. The damping body is operatively connected to the nozzle needle, and as a function of its position in the nozzle bore it opens up a communication between the damping chamber and the outflow chamber.

The damping body and the nozzle needle are two separate bodies, so that a force oriented radially to their axis, caused for instance by displacement toward one another of the injector bodies that guide the damping body and the nozzle needle, does not lead to shear forces or bending forces on the damping body and/or the nozzle needle.

The damping body is also guided in the damping bore over at least a substantial part of the length of the damping body and/or of the damping bore, and preferably over the entire length of the damping bore, so that canting of the damping body in the damping bore is averted. The annular gap between the damping body and the damping bore can be made so narrow that even given its slight axial length, which at maximum is as long as the damping stroke, it has a sealing effect.

To produce the fuel injection valve and to set the damping stroke, the fuel pressure in the fuel conduit and in the outflow chamber is first measured in a test setup, and from that, a conclusion is drawn about the damping stroke or the total stroke; the damping stroke in the fuel injection valve is then set. Production variations in the damping stroke are advantageously compensated for by the insertion of a compensation disk, whose thickness is selected as a function of the measured damping stroke.

Preferred exemplary embodiments of the invention are described in further detail below in conjunction with the drawings, in which:

DESCRIPTION OF THE PREFERRED EMBODIMENTS

Figure 1:
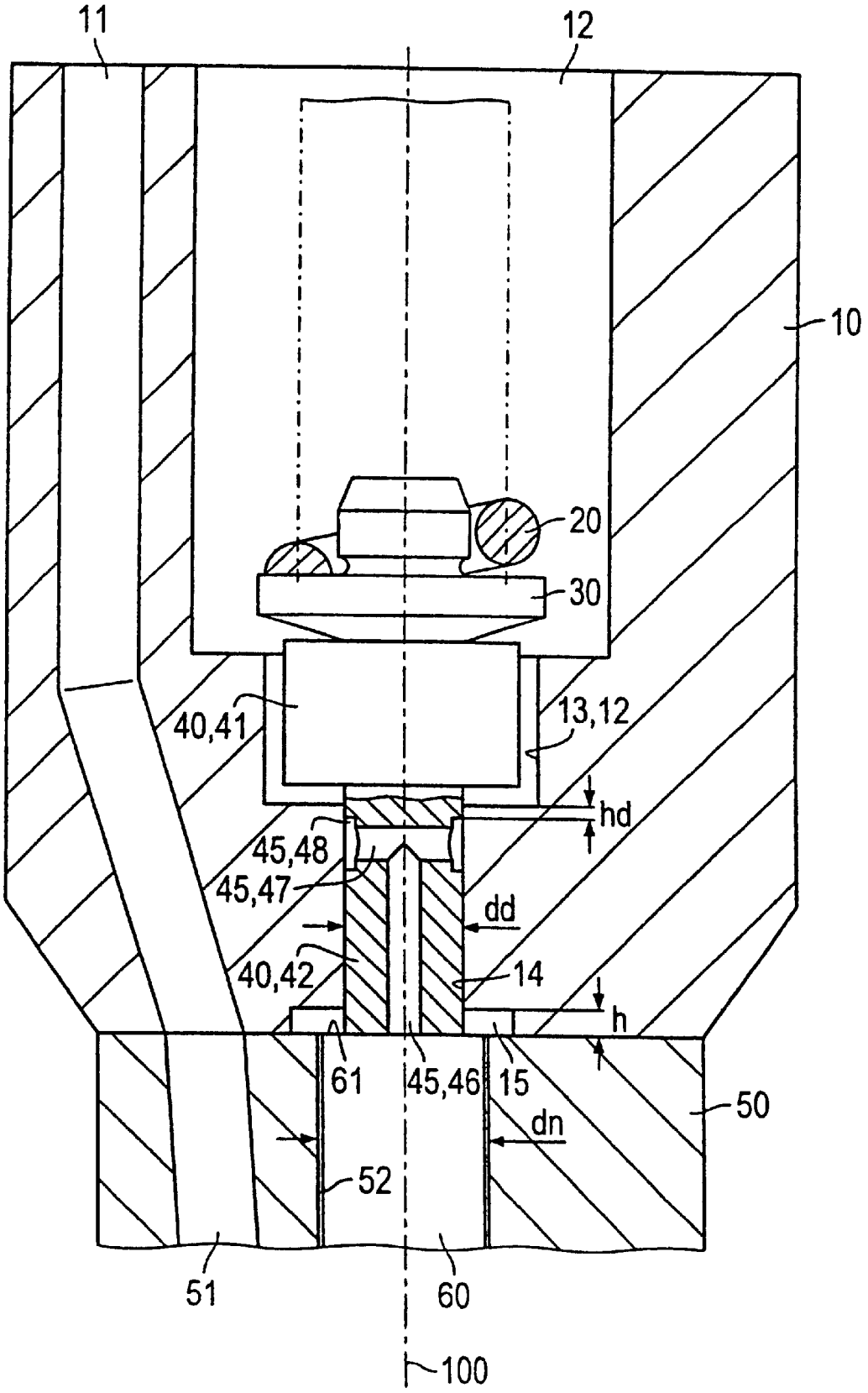
FIG. 1 is a longitudinal section through parts of the fuel injection valve having a first damping body.

FIG. 1 shows a longitudinal section through parts of a rotationally symmetrical fuel injection valve, which has a nozzle body 50 and a damping unit 10, which are preferably planar on their end faces and which are braced against one another, thus creating a pressure proof seal. A nozzle needle 60 is guided axially in the central guide bore 52 of the nozzle body 50; the tip of the nozzle needle 60 and the tip of the nozzle body 50 form an injection valve, in the form of an encompassing sealing edge or sealing face, with which the injection of the fuel into a combustion chamber is controlled. Upon valve opening, the nozzle needle 60 is deflected out of its closing position, and as a result the injection valve opens and fuel is injected into the combustion chamber.

The rear end of the nozzle needle 60 is preferably embodied as an end face 61 disposed perpendicular to the longitudinal axis 100 of the fuel injection valve, and it points into a compression chamber 15, which is formed by an end piece of the guide bore 52 of preferably larger diameter and limits the deflection of the nozzle needle 60 to a total stroke h; the total stroke h is equivalent to the maximum deflection of the nozzle needle 60. The recess for the compression chamber 15 is preferably made in the damping unit 10, but it can also be made in the nozzle body 50. The end face 61 of the nozzle needle 50 is operatively connected to a first damping body 40, which is preferably embodied as a piston with a basically cylindrical shape and is guided in the central damping bore 14, adjoining the compression chamber 15, of the damping module 10. The needle diameter dn, which is equivalent to the diameter on the rear end of the nozzle needle 60, is greater than the piston diameter dd, which is equivalent to the diameter of the end of the damping body 40 contacting the nozzle needle 60.

The compression chamber 15 has a chamber volume that is defined by the end face 61 of the nozzle needle 60, the wall of the compression chamber 15, and the end face, toward the nozzle needle, of the damping body 40.

The damping body 40 is subdivided into a first body portion 42 and a second body portion 41 of greater diameter. A spring 20, via a spring plate 30, prestresses the damping body 40 toward the nozzle needle 60.

Beginning at the compression chamber 15, the damping bore 14 passes along the longitudinal axis 100 of the fuel injection valve and merges with a piston recess 13 for receiving the second body portion 41 and then widens into an outflow chamber 12, in which the spring 20 and the spring plate 30 are accommodated; thus the piston recess is part of the outflow chamber 12.

The first fuel conduit 11 extends in the damping unit 10 and merges with the second fuel conduit 51, which is placed in the nozzle body 50.

The damping unit 10 and the nozzle body 50 are so firmly braced together by their end faces, preferably via a tension element, that the fuel conduits 11, 51 and the compression chamber 14 are closed off in pressure proof fashion.

The fuel pressure in the fuel conduits 11, 51, in a pressure chamber not shown, acts upon the nozzle needle with an opening force that acts counter to the spring force exerted by the spring 20. If the fuel pressure in the fuel conduit 11, 51 exceeds a predetermined fuel pressure, or if the closing force acting on the nozzle needle 60 in the direction of the nozzle tip is reduced via a servo valve, not shown, then the nozzle needle 60 is deflected in the direction of the compression chamber 15, and as a result the injection valve opens, and fuel is injected into the combustion chamber of the engine. The damping bore 14 surrounds and guides the damping body 40, and together with the recesses 46, 47, 48 of the damping body 40 it defines a fuel-filled damping chamber 45 with a damping volume. The damping body 40 has a central longitudinal bore 46, which intersects the wall of a transverse bore 47 that extends transversely to the longitudinal axis 100 in the damping body 40 and has one or preferably two openings, which point into an encompassing annular groove 48 made in the damping body 40.

The compression chamber 15 and the damping chamber 45 communicate hydraulically with one another. In the closing position of the nozzle needle 60, the encompassing edge, pointing in the direction of the outflow clamber 12, of the annular groove 48 has an axial spacing from the outflow chamber 12 that is equivalent to the damping stroke hd.

The valve opening is delayed as follows:

During the valve opening, the damping body 40 that is operatively connected to the nozzle needle 60 is deflected along with the nozzle needle 60. The nozzled needle 60, at its end face 61, forces the fuel into the compression chamber 15.

Since the needle diameter dn is greater than the piston diameter dd, upon valve opening the total volume that is enclosed by the compression chamber 15 and the damping chamber 45 is reduced, and as a result the fuel in the compression chamber 15 and the damping chamber 45 is compressed, and the fuel pressure is increased. As a result, a damping force that counteracts the deflection of the nozzle needle 60 acts on the end face 61 of the nozzle needle 60. The damping force is dependent on the total volume, on the needle diameter dn, on the piston diameter dd, and on the deflectlon of the nozzle needle 60. If the deflection of the nozzle needle 60 exceeds a predetermined damping strike hd, then the edge, toward the outflow chamber 12, of the annular groove 48 of the damping body 40 is located above the damping bore 14 in the outflow chamber 12, 13, and as a result fuel flows out of the damping chamber 45 into the outflow chamber 12 via the annular groove 48, and thus the compressed fuel is depressurized. The edge of the annular groove 48, the damping body 40 and the damping bore 14 thus form a valve 14, 48, 40. Thus the valve 14, 48, 40 opens when the nozzle needle 60 reaches a predetermined desired position. The fuel pressure in the outflow chamber 12 is low in comparison with the pressure in the damping chamber and is preferably equivalent to the fuel pressure in the fuel tank that adjoins the outflow chamber 12. After the deflection of the nozzle needle 60 by a predetermined damping stroke hd, no further damping force is exerted on the end face 61 of the nozzle needle 60, and thus the deflection of the nozzle needle 60 is no longer delayed.

The delaying of the motion of the valve opening is advantageously adjustable by means of a suitable selection of the needle diameter dn, the piston diameter dd, the volume of the damping chamber 45 and compression chamber 15, and the length of the damping stroke hd.

The fuel injection valve is embodied especially advantageously if in short deflection processes of the nozzle needle 60, of the kind that are usual for a pilot injection into the combustion chamber, the deflection of the nozzle needle 60 is less than the damping stroke hd, so that during the pilot injection the entire deflection of the nozzle needle 60 is damped.

During the main injection, a damped deflection of the nozzle needle 60 over its total stroke h is not desired; instead, what is desired is the fastest possible opening and closing of the nozzle needle 60, so that a predetermined fuel quantity can be injected into the combustion chamber within a short time. This is attained by delaying the valve opening only during what in comparison with the total stroke h is a short damping stroke hd, while from the damping stroke hd to the total stroke h the valve opening is not delayed by the effect of the compressed fuel.

The delay in the valve opening is adjustable by the aforementioned characteristics, so that during a pilot injection, a predeterminable, small injection quantity is advantageously injected into the combustion chamber. During the motion of the valve closing 60 that is counter to the valve opening, the total volume increases, because of the mutually different needle diameter an and piston diameter dd. Via an inflow conduit, not shown, that has a return valve, replenishing fuel flows from the fuel conduit 11, 41 into the compression chamber 15 and the damping chamber 45. During the total stroke h, the motion of the needle closing is not delayed by the fuel in the compression chamber 15 and in the damping chamber 45.

The damping body 40 and the nozzle needle 60 are embodied as separate bodies from one another, so that a force oriented radially to their axis and caused for instance by displacement of the damping unit 10 and nozzle body 50 counter to one another, does not lead to shearing or bending forces on the damping body and/or the nozzle needle, but merely displaces their end faces counter to one another.

The damping body 40 is guided in the damping bore 14 over at least part of the axial length of the damping body 40 and/or of the damping bore 14, and preferably over a substantial portion, or all, of the length of the damping bore 14, so that canting of the damping body in the damping bore is avoided. The annular gap between the damping body 40 and the damping bore 14 is embodied as so narrow that even given its slight axial length from the edge of the annular groove located toward the outflow chamber to the beginning of the outflow chamber 12, which at most is substantially as long as the damping stroke hd, it has a sealing or at least strongly throttling effect.

The first body portion 41 has a larger diameter than the second body portion 42, so that when the fuel injection valve is being assembled the damping body 40 will not be inserted incorrectly into the damping bore 14.

Figure 2:
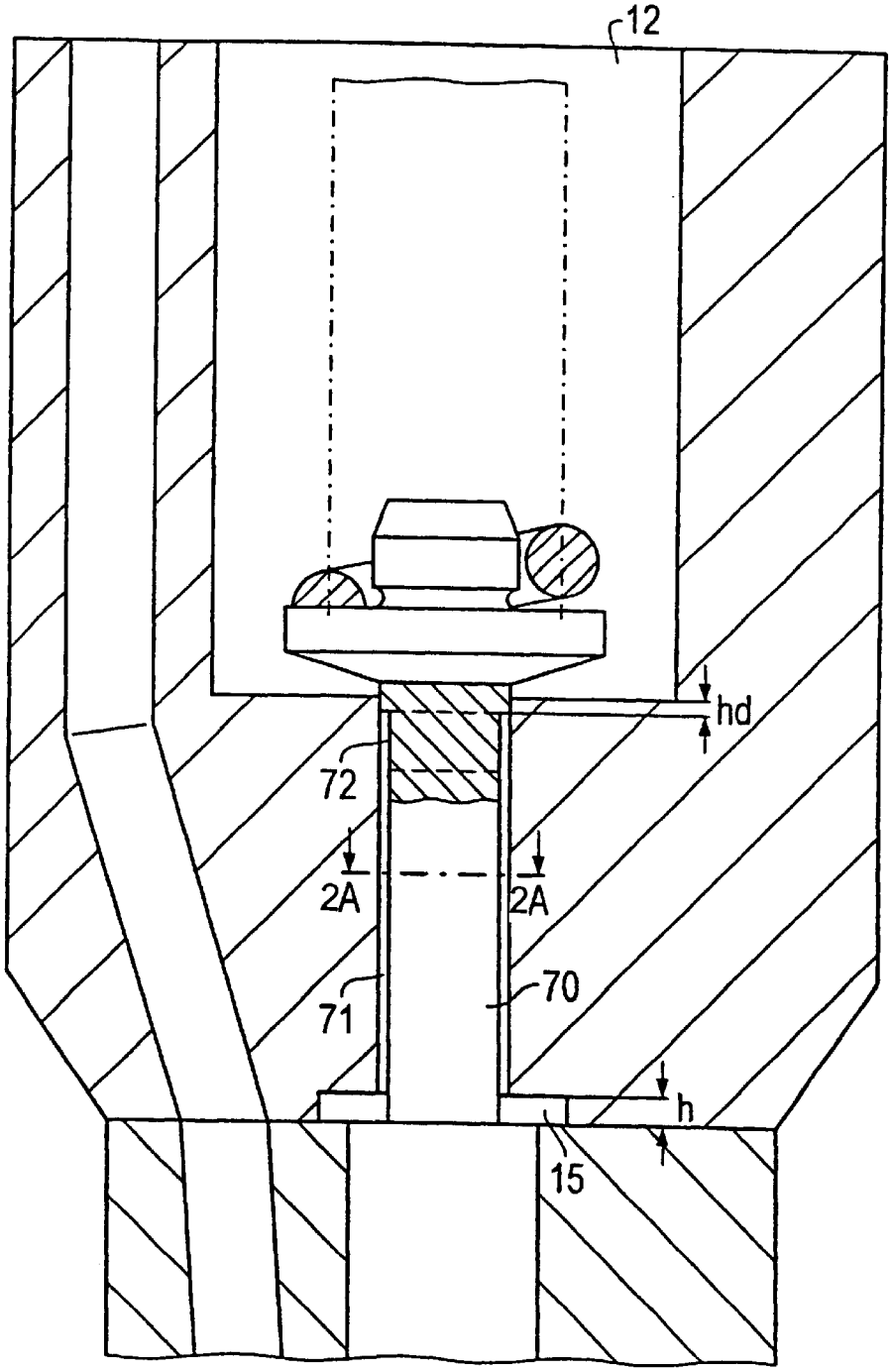
FIG. 2 is a longitudinal section through parts of a fuel injection valve having a second damping body.

FIG. 2 shows a longitudinal section through parts of the fuel injection valve; in comparison with the first damping body 40 in FIG. 1, the second damping body 70 in FIG. 2 is embodied as a cylindrical body of constant diameter over its entire length. Also, preferably two opposed longitudinal grooves 71 are disposed on the second damping body 70, from its end face resting on the nozzle needle 50 as far as its second annular groove 72. The longitudinal grooves 71 are recesses that are made in the damping body 40. The damping chamber 71, 72, comprising the longitudinal grooves 71 and the second annular groove 72, is advantageously reduced in such as thus amplifies the delaying of the valve opening during the damping stroke hd. The damping body 70, having a constant diameter, is also easier to manufacture.

In a further embodiment, recesses embodied as longitudinal grooves or cylindrical widenings are made in the wall of the damping bore 14; they lead from the compression chamber 15 as far as the annular groove 48.

Figure 2A:
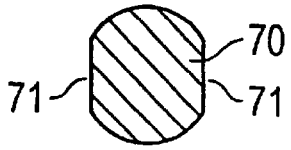
FIG. 2*a* is a cross section taken along the line A—A through the second damping body of FIG. 2.

FIG. 2*a* shows the cross section A—A of the second damping body 70, with preferably two opposed longitudinal grooves 71; a symmetrical radial force is advantageously exerted on the damping body 70 by the fuel.

Figure 3:
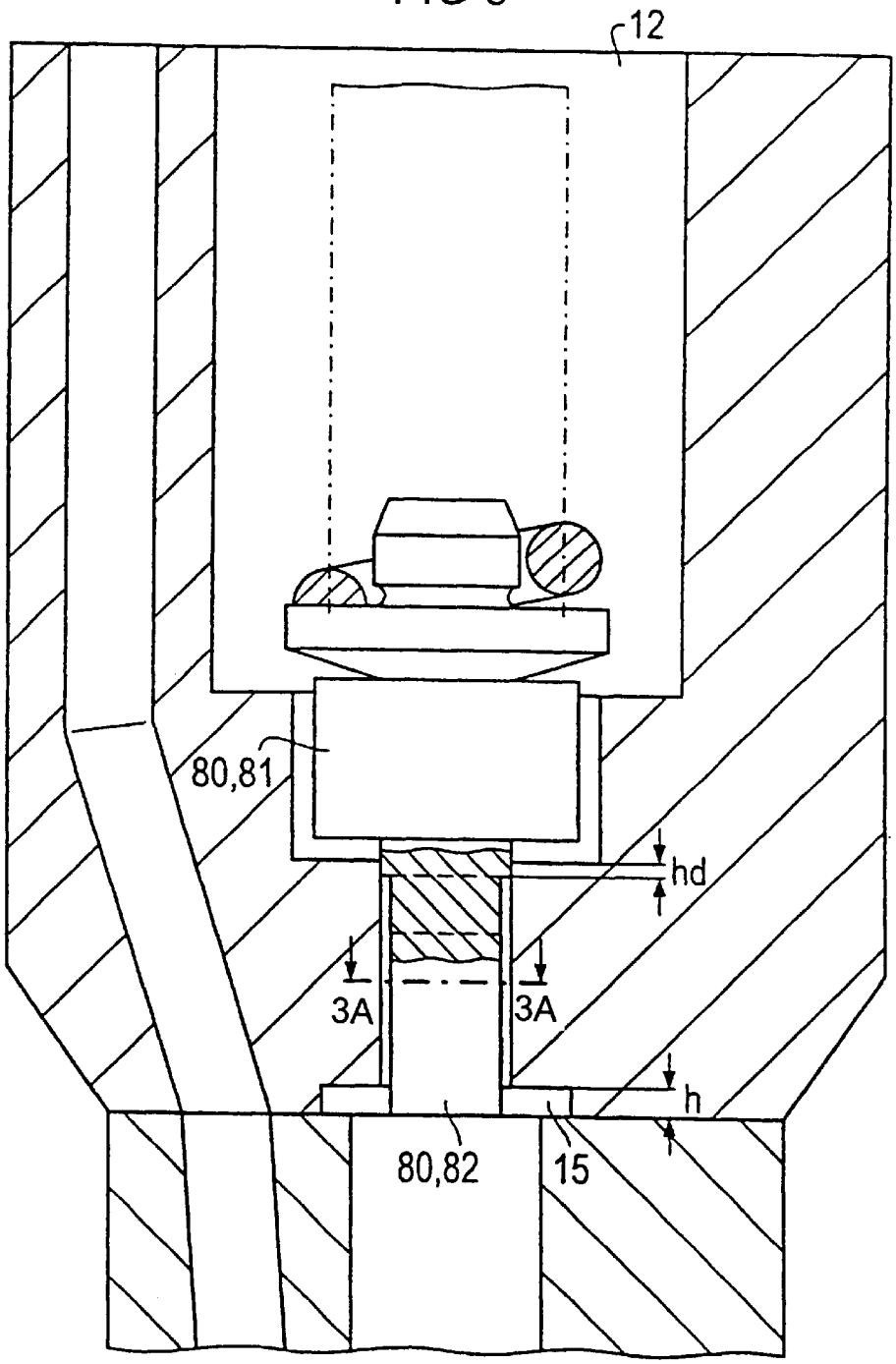
FIG. 3 is a longitudinal section through parts of a fuel injection valve having a third damping body.

In FIG. 3, the damping chamber of a third damping body 80 is formed, like the damping chamber 71, 72 of FIG. 2. In contrast to FIG. 2, the third damping body 80 is subdivided, as in FIG. 1, into a first and a second body portion 81, 82.

Figure 3A:
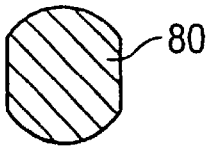
FIG. 3*a* is a cross section taken along the line B—B through the second damping body of FIG. 3.

FIG. 3*a* shows the cross section B—B through the third damping body 80.

Figure 4:
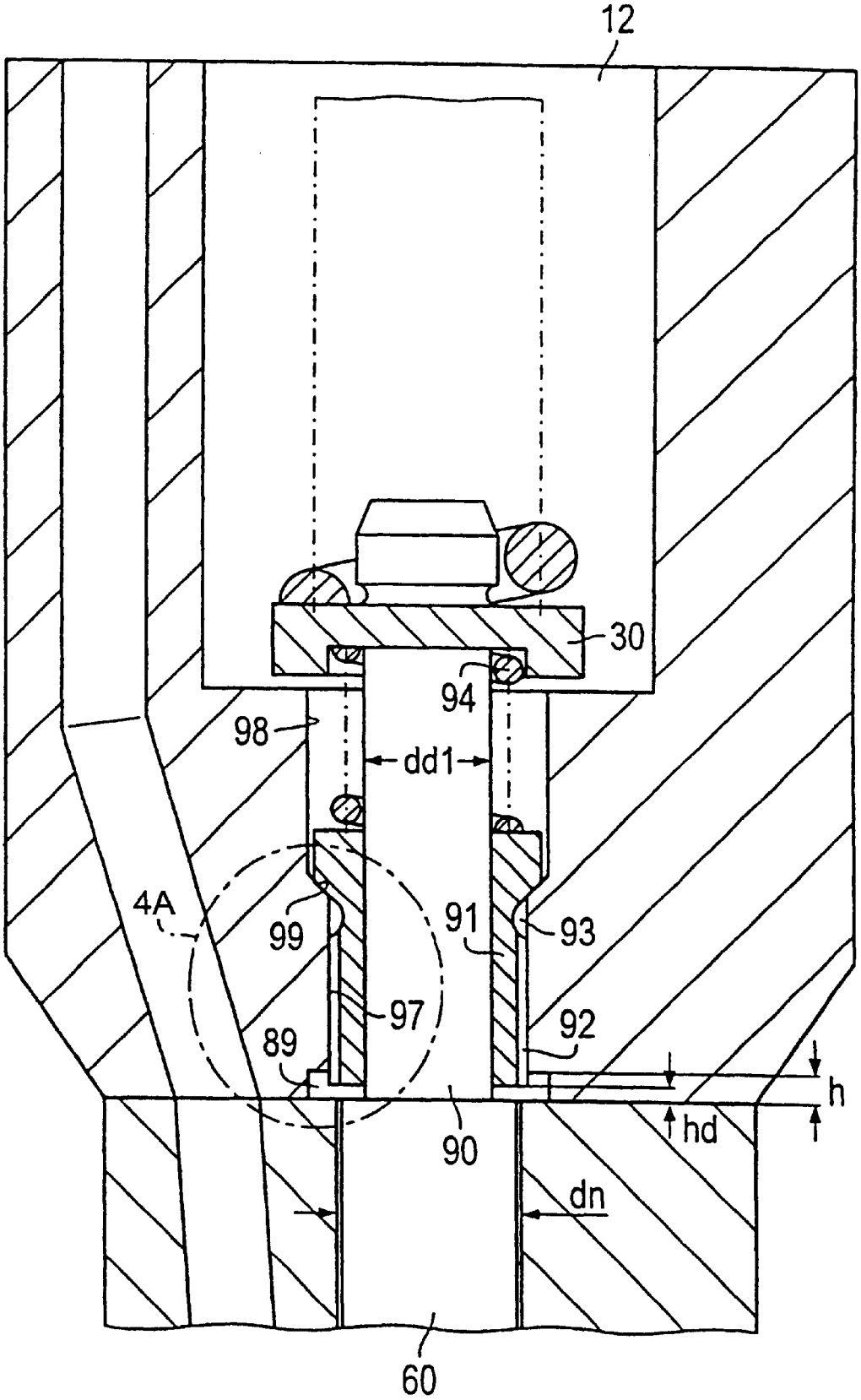
FIG. 4 is a longitudinal section through parts of a fuel injection valve having a damping sleeve.

In FIG. 4, a longitudinal section is shown through parts of the fuel injection valve; in comparison with the exemplary of FIG. 2, a cylindrical piston 90 with a further piston diameter dd1 is fastened between the spring plate 30 and the nozzle needle 60; it is surrounded and guided over part of its length by a damping body embodied as a damping sleeve 91. A second damping bore 97, 98 is subdivided, for guiding the damping sleeve 91, into a first portion 97 and a second portion 98, the latter being disposed in the direction of the spring plate and having a larger diameter. The damping sleeve 91 is guided in the first portion 97 and widens preferably conically in the part of the damping sleeve 91 located in the second portion 98; the valve seat of the damping bore 97, 98 and the preferably conical widening of the damping sleeve form a valve 99, which closes off the damping chamber 93, 92 from the outflow chamber 12.

The damping sleeve 91 and the second portion 98 of the damping bore form a damping chamber 93, 92, which comprises two longitudinal grooves 92 and a rounded annular chamber 93 adjoining them; this annular chamber merges with a preferably conical face of the damping sleeve 91, from which point the damping sleeve 91 extends cylindrically to its end face.

The spring plate 30 exerts a closing force on the valve 99 via a damping spring 94.

In the closing position of the nozzle needle 60, the end face toward the nozzle needle of the damping sleeve 91 has a damping spacing hd from the end face 61 of the nozzle needle 60.

Figure 4A:
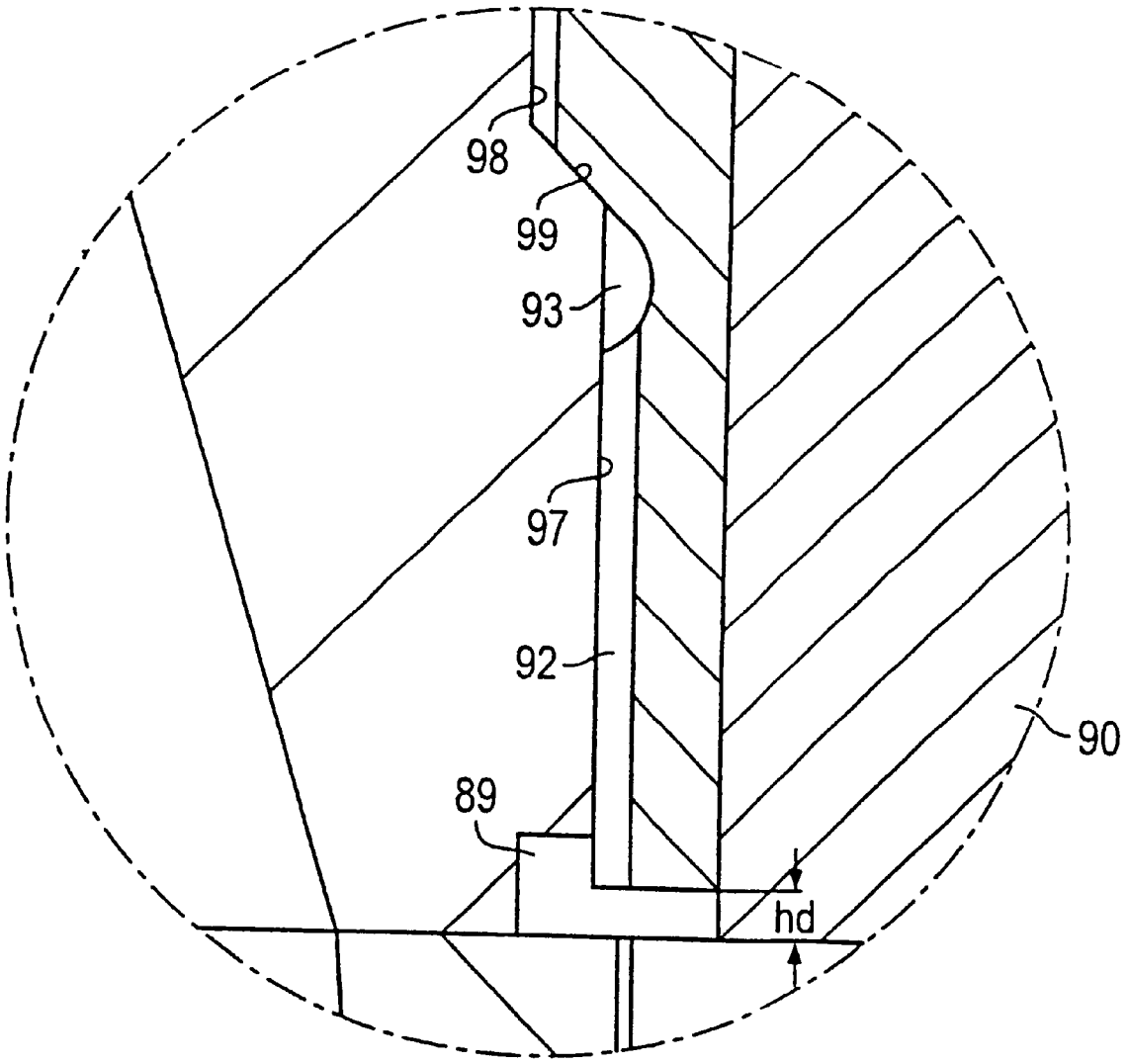
FIG. 4*a* is an enlargement of the detail marked C in FIG. 4.

In FIG. 4*a*, this region (detail C) is shown enlarged for the sake of clarity.

A further compression chamber 89, disposed as in FIG. 1, has a chamber volume which is defined by the end face 61 of the nozzle needle 60, the wall of the compression chamber 89, the piston 90, and the end face, toward the nozzle needle, of the damping sleeve 91.

During the valve opening, the valve 99 remains closed as long as the deflection of the nozzle needle 60 does not exceed the damping stroke hd. Since the needle diameter dn of the nozzle needle 60 is greater than the further piston diameter dd1 of the piston 90, the volume of the further compression chamber 89 and of the damping chamber 93, 92 decreases upon valve opening; the fuel is compressed thereby, and a delay in valve opening results. If the deflection of the nozzle needle 60 exceeds the damping stroke hd, then the end face 61 of the nozzle needle 60 strikes the end face of the damping sleeve 91 and deflects the damping sleeve 91 in the direction of the spring plate 30. This causes the valve 99 to open, and thus the compressed fuel flows out of the compression chamber 15 and the damping chamber 93, 92, and the damping action and the delay in the valve opening thus cease.

The damping stroke hd depends on the production variations in the damping sleeve 91, damping unit 10, nozzle needle 60, and nozzle body 50. By measuring the axial spacing between the end toward the nozzle needle, of the damping unit 10 and the damping sleeve 91 while the valve 99 is closed, the damping stroke hd shown in FIG. 4 is determined directly. By inserting a damping sleeve 91 with a sleeve length that compensates for the production variations, a predeterminable damping stroke hd is set.

Figure 5:
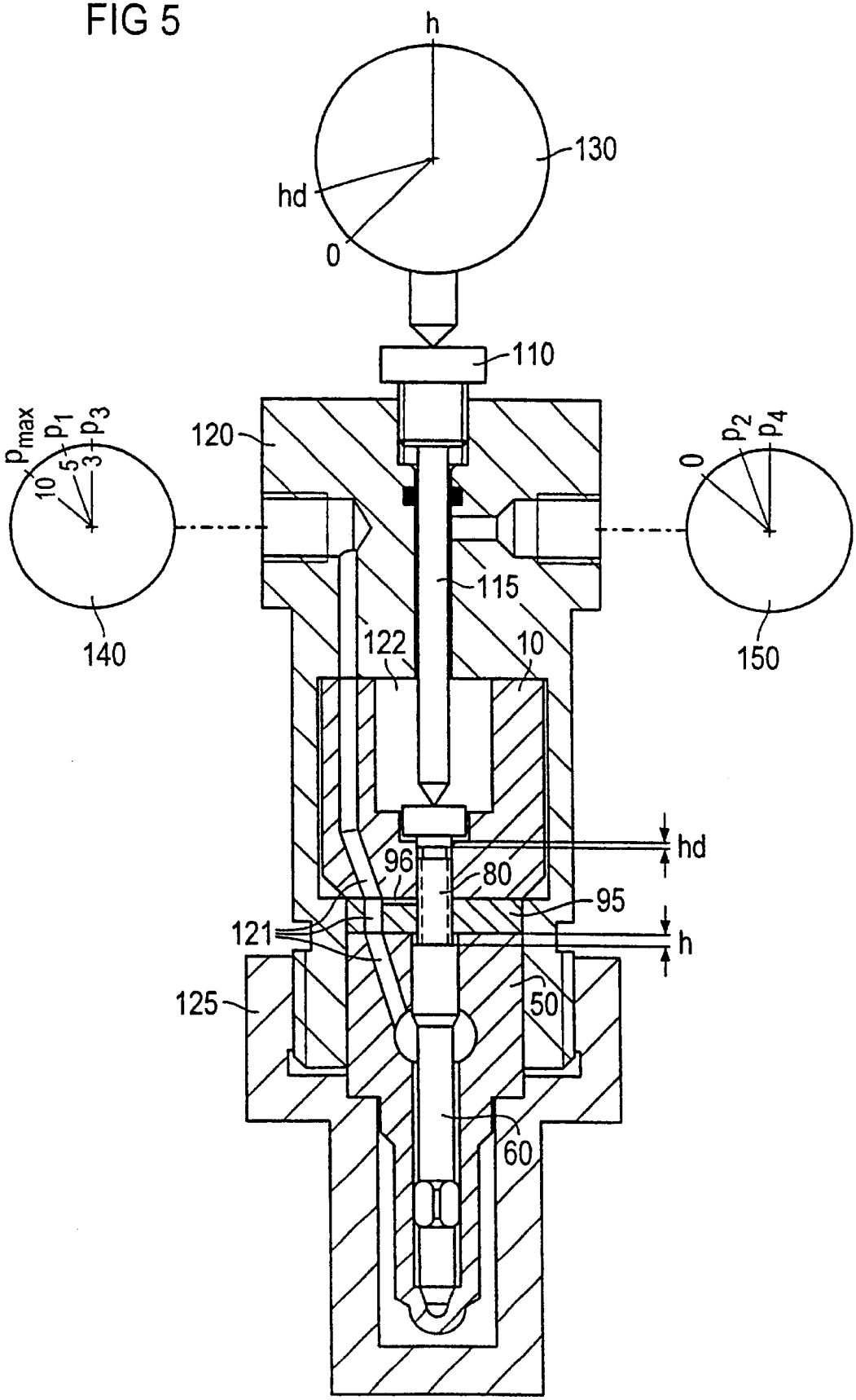
FIG. 5 is a longitudinal section through a device for ascertaining and setting the damping stroke of a fuel injection valve.
Figure 6:
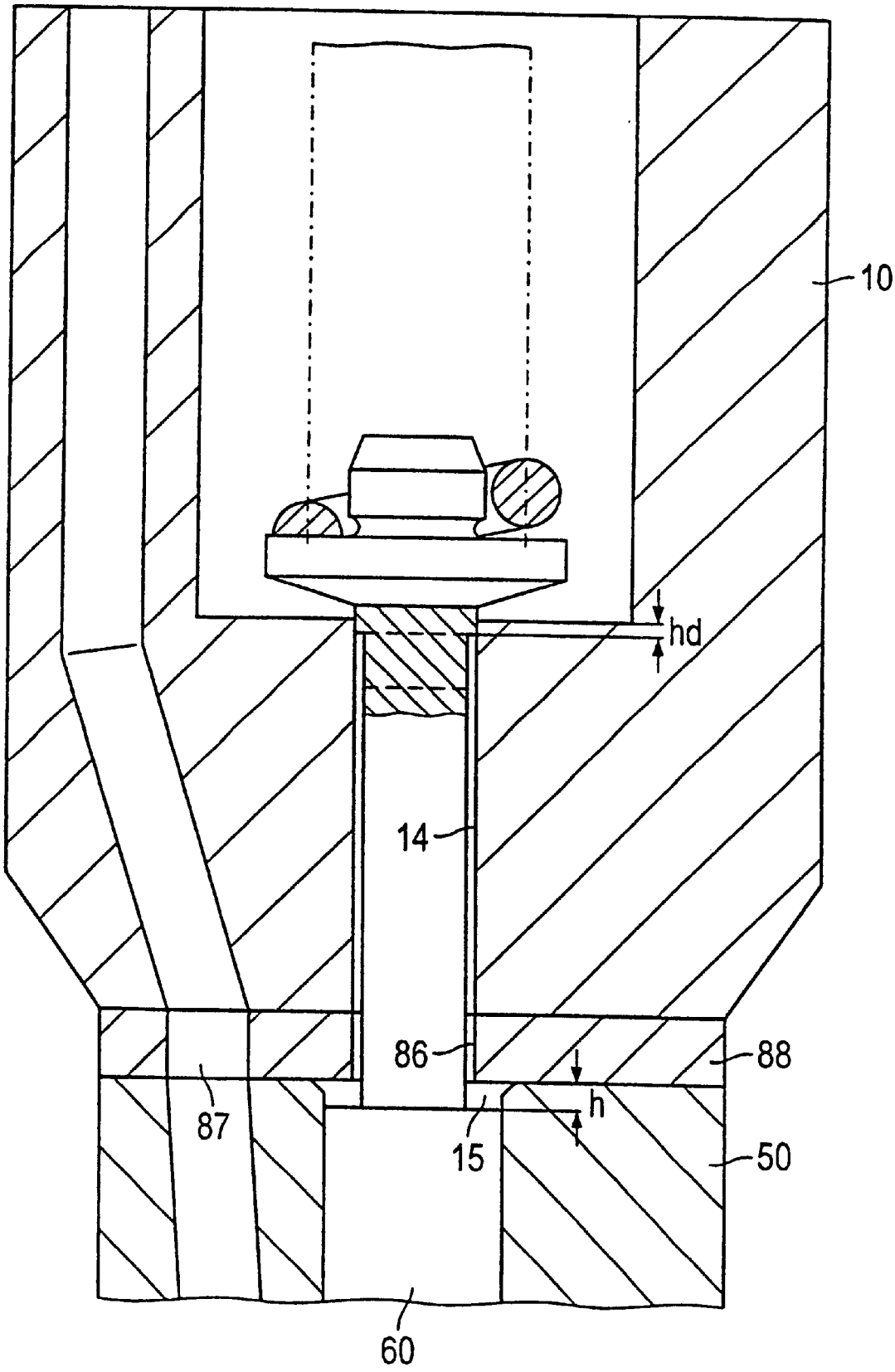
FIG. 6 is a longitudinal section through parts of a fuel injection valve having a compensation disk.

FIG. 5 shows a device for measuring the damping stroke hd shown in FIGS. 1–3. The structure of the damping body 80 and the damping unit 10 in this device are equivalent to that in the exemplary embodiment of FIG. 3, but can also be equivalent to the structure of FIG. 1 or FIG. 2. In the manufacture of the fuel injection valve, the attained damping stroke hd may deviate relatively sharply from a predetermined desired value, since the damping stroke hd is dependent on the production variations in the damping body 80, damping unit 10, nozzle needle 60 and nozzle body 60. To compensate for the production variations, with the arrangement described below the damping stroke hd of a fuel injection valve is ascertained, and with a thickness between the damping unit 10 and the nozzle body 50 that compensates for the production variations, a predeterminable damping stroke hd is set. An exemplary embodiment with a compensation disk is shown in FIG. 6.

In FIG. 5, a test compensation disk 95 is fastened between the damping unit 10 and the nozzle body 50 and has a fuel conduit 121 and a connecting conduit 95, which connects the fuel conduit 121 with the damping chamber of the damping body 80. The damping body 10, the test compensation disk 95 and the nozzle body 50 are fastened in a test module 120 by a tension element 125. A setting screw 110 placed in the central bore of the test module 120 acts on the damping body 80 via a setting needle 115 and determines the deflection of the nozzle needle 60, which is measured via a dial gauge 130. The inflow pressure of the fuel in a fuel conduit 121 and the outflow pressure in an outflow chamber 122 are measured by a first and second manometer 140, 150. The fuel is delivered to the fuel conduit via a throttle, which is disposed upstream of the first manometer 140. The fuel flows out via a throttle that is disposed downstream of the second manometer 150.

The method for ascertaining the damping stroke hd is performed as follows:

In the closing position of the nozzle needle 60, the fuel in the fuel conduit has a maximum pressure pmax. The outflow pressure in the outflow chamber is zero, because no fuel is flowing out into the outflow chamber.

By rotating the setting screw 110, the nozzle needle 60 is deflected slowly in the direction of the damping unit 10. The inflow pressure drops steadily until the damping stroke hd is reached, because by the opening of the injection valve, fuel is dispensed into the surroundings. The outflow pressure is still zero.

If the deflection of the nozzle needle 60 exceeds the damping stroke hd, causing fuel to flow via the connecting conduit 96 and the damping chamber into the outflow chamber 12, the inflow pressure drops and the inflow pressure suddenly rises to the values p1 and p2. Thus the damping stroke hd can be ascertained indirectly from the pressure course at the manometers 140, 150.

By further rotation of the setting screw 110, the nozzle needle 60 is moved onward as far as the total stroke h. The inflow pressure drops, and the outflow pressure rises steadily. When the total stroke h is reached, the inflow pressure adjusts to a minimal value p3, and the outflow pressure adjusts to a maximal value p4, which does not vary further upon further rotation of the setting screw 110. The total stroke h can thus be ascertained indirectly from the pressure course at the manometers 140, 150.

In FIG. 6, parts of a fuel injection valve are shown, in which in a distinction from FIG. 2, a cylindrical compensation disk 88 is disposed between the damping unit 10 and the nozzle body 50, in which compensation disk a fuel conduit 87 and a central disk bore 86 that adjoins the damping bore 14 of the damping unit 10 are made. By the selection of a compensation disk 88 with a predetermined thickness, the damping stroke hd can be set as described in the exemplary embodiment of FIG. 4. The compression chamber 15 is made preferably in the form of a chamfer in the nozzle body 50 and is bounded by the compensation disk 88. Upon maximal deflection, the nozzle needle 60 strikes the compensation disk of the nozzle needle 60 and is thus deflected by the total stroke h.

The principle described here of the damping of valve opening can be employed also in fuel injection valves in which the valve opening is effected by an axial motion of the nozzle needle in the direction of the tip of the nozzle, as in the case of pintle nozzles, for example. The piston diameter of the damping body is then greater than the nozzle needle diameter.

One skilled in the art will construct an advantageous fuel injection valve from combinations of the exemplary embodiments described as well, to suit given peripheral conditions.

What is claimed is:

1. A fuel injection valve, comprising:

a valve body formed with a guide bore and a nozzle needle guided in said guide bore, said guide bore discharging into a compression chamber communicating with an outflow chamber;

a valve between said compression chamber and said outflow chamber, said valve having a damping body axially displaceable in a damping bore, said damping body connecting the compression chamber with the outflow chamber in dependence on a degree of deflection of the nozzle needle;

said damping body and said nozzle needle being two separate bodies operatively connected to one another;

said damping body being guided over at least a substantial portion of a length thereof in said damping bore;

said damping bore being divided into a first portion and a second portion having a larger diameter than the first portion, and a valve seat merging the second portion with the first portion; and said damping body being a damping sleeve guiding therein a piston in an axially displaceable manner, and said damping sleeve:

being guided in the first portion;

having a larger diameter at a level of the second portion than at a level of the first portion; and together with the valve seat forming a valve between the compression chamber and the outflow chamber;

said piston being operatively connected to said nozzle needle; and said nozzle needle, upon a deflection thereof by more than a predeterminable damping stroke, deflecting said damping sleeve and opening said valve.

2. The fuel injection valve according to claim 1, wherein said damping body is formed with an annular groove, with a transverse bore having a wall and an opening ending in said annular groove, and with a central longitudinal bore intersecting said wall of said transverse bore.

3. The fuel injection valve according to claim 1, wherein said damping body is formed with at least one longitudinal groove which ends in an annular groove surrounding said damping body.

4. The fuel injection valve according to claim 1, wherein said nozzle needle has a given needle diameter and said damping body has a piston diameter smaller than said needle diameter.

5. The fuel injection valve according to claim 1, wherein said damping body is divided into a first body portion with said damping chamber and a second body portion having a greater diameter than said first body portion.

6. The fuel injection valve according to claim 1, which comprises a compensation disk disposed between said damping unit and said nozzle body.

7. The fuel injection valve according to claim 1, wherein said piston has a further piston diameter and said nozzle needle diameter is greater than the further piston diameter.

8. The fuel injection valve according to claim 1, wherein a deflection of said nozzle needle at which said valve opens is smaller than a total stroke of said nozzle needle.

9. The fuel injection valve according to claim 1, which further comprises a spring disposed to axially prestress said damping body in a direction of said nozzle needle.

10. A method of adjusting a predeterminable damping stroke of a fuel injection valve provided with a damping body, which comprises the following steps:

measuring a damping stroke attained with a fuel injection valve, by inserting a test compensation disk between said damping unit and said nozzle body, the compensation disk being formed with a connecting conduit between a fuel conduit and a compression chamber;

defining a deflection of the nozzle needle by a setting screw;

measuring an inflow pressure in the fuel conduit and an outflow pressure in an outflow chamber as a function of the deflection of the nozzle needle, whereby the outflow pressure rises and the inflow pressure falls if the deflection of the nozzle needle exceeds the damping stroke and a conclusion can be drawn from the inflow pressure, the outflow pressure, and the position of the setting screw, about the damping stroke; and setting the damping stroke in the fuel injection valve by introducing a compensation disk between the damping unit and the nozzle body.

* * * * *